US008413598B2

(12) United States Patent
Ouchi et al.

(10) Patent No.: US 8,413,598 B2
(45) Date of Patent: Apr. 9, 2013

(54) SAILING SHIP

(75) Inventors: Kazuyuki Ouchi, Nagano (JP); Kiyoshi Uzawa, Nagano (JP); Gaku Kimura, Sizuoka (JP)

(73) Assignees: Ouchi Ocean Consultant, Inc., Nagano (JP); GH Craft Ltd, Sizouka (JP)

( * ) Notice: Subject to any disclaimer, the term of this patent is extended or adjusted under 35 U.S.C. 154(b) by 230 days.

(21) Appl. No.: 13/051,841

(22) Filed: Mar. 18, 2011

(65) Prior Publication Data

US 2011/0226172 A1 Sep. 22, 2011

(30) Foreign Application Priority Data

Mar. 19, 2010 (JP) ..... 2010-065143

(51) Int. Cl.
*B63B 35/00* (2006.01)

(52) U.S. Cl.
USPC ..... 114/39.29; 114/90; 114/102.29

(58) Field of Classification Search ..... 114/39.29, 114/39.3, 90, 91, 102.1, 102.26, 102.29, 114/102.31, 102.33, 104, 105, 106
See application file for complete search history.

(56) References Cited

U.S. PATENT DOCUMENTS

| | | | | |
|---|---|---|---|---|
| 4,685,410 | A * | 8/1987 | Fuller | 114/39.31 |
| 5,263,429 | A * | 11/1993 | Brinkmann | 114/105 |
| 5,271,349 | A * | 12/1993 | Magrini | 114/102.33 |
| 5,628,416 | A | 5/1997 | Frommelt et al. | |
| 2010/0199905 | A1 | 8/2010 | Ouchi et al. | |

FOREIGN PATENT DOCUMENTS

| | | | |
|---|---|---|---|
| JP | 61-200091 | A | 9/1986 |
| JP | 7267584 | A | 10/1995 |
| JP | 2000-159483 | A | 6/2000 |
| JP | 3212467 | | 7/2001 |
| JP | 2005-280533 | A | 10/2005 |
| JP | 2006-111026 | A | 4/2006 |
| JP | 4263280 | | 2/2009 |
| JP | 2009-214633 | A | 9/2009 |

OTHER PUBLICATIONS

Office Action issued in corresponding Korean patent application on Oct. 19, 2012, and partial English translation thereof.

* cited by examiner

*Primary Examiner* — Lars A Olson
(74) *Attorney, Agent, or Firm* — Griffin & Szipl, P.C.

(57) ABSTRACT

A sailing ship includes a sailing unit, which comprises a hard sail assembly comprising a plurality of hard sail sections of wing-shaped hollow cross section vertically stacked so each, except the lowermost, fits on the one immediately below; a mast assembly comprising a plurality of mast sections of hollow cross section vertically stacked so each, except the lowermost, fits in the one immediately below; connecting members for connecting upper ends of the hard sail sections to upper ends of the mast sections located at the same level; first means for moving each mast section, except the lowermost, toward and away from the one immediately below; and second means for rotating the mast assembly around its longitudinal axis. Overlapping lengths between vertically adjacent mast sections are variably controlled so as to variably control overlapping lengths between vertically adjacent hard sail sections. Thus, the hard sail assembly vertically expands and contracts.

4 Claims, 5 Drawing Sheets

(a)

(b)

(c)

(d)

SAILING SHIP

This application claims priority from Japanese Patent Application No. 2010-065143, filed Mar. 19, 2010, the entire disclosure of which is incorporated herein by reference.

FIELD OF THE INVENTION

The present invention relates to a sailing ship comprising a sailing unit, which comprises a hard sail.

BACKGROUND OF THE INVENTION

A sailing ship comprising a sailing unit which comprises a hard sail is disclosed in Japanese Patent Laid-Open Publication No. 2005-280533.

The hard sail can be contracted transversely but its height cannot be changed. Therefore, the hard sail may obstruct passage of the ship under bridges.

An object of the present invention is to provide a sailing ship comprising a sailing unit that comprises a hard sail of changeable height.

SUMMARY OF THE INVENTION

In accordance with the present invention, there is provided a sailing ship comprising a sailing unit which comprises a hard sail assembly comprising a plurality of hard sail sections of wing-shaped hollow cross section vertically stacked so that each except the lowermost fits on the one immediately below, a mast assembly comprising a plurality of mast sections of hollow cross section vertically stacked so that each except the lowermost fits in the one immediately below, connecting members for connecting the upper ends of the hard sail sections to the upper ends of the mast sections located at the same level, first means for moving each mast section except the lowermost toward and away from the one immediately below, and second means for rotating the mast assembly around its longitudinal axis, wherein overlapping lengths between vertically adjacent mast sections are variably controlled to variably control overlapping lengths between vertically adjacent hard sail sections, thereby vertically expanding and contracting the hard sail assembly.

In the sailing ship of the present invention, the first means variably controls overlapping lengths between vertically adjacent mast sections so as to variably control overlapping lengths between vertically adjacent hard sail sections, thereby expanding and contracting the hard sail assembly. The second means directs the expanded hard sail assembly in the optimum direction relative to the wind.

In the sailing ship of the present invention, the hard sail assembly comprises a plurality of hard sail sections of wing-shaped hollow cross section vertically stacked and can expand and contract to change its height. Therefore, the height of the hard sail assembly can be adjusted so as not to obstruct passage of the ship under bridges.

In the sailing ship of the present invention, chord length of the hard sail assembly in expanded condition increases from the lower portion to the higher portion because the each hard sail section except the lowermost fits on the one immediately below. On the other hand, wing velocity increases as the height from the deck of the sailing ship increases. Therefore, the hard sail assembly of the sailing ship of the present invention can efficiently catch the wind force.

In the sailing ship of the present invention, the upper ends of the hard sail sections are connected to the upper ends of the mast sections located at the same level so that the hard sail sections are supported by the mast sections located at the same level. Therefore, the sailing unit can be made lightweight and imparted with appropriate strength by making the hard sail sections, which are large sized, of lightweight resin and making the mast sections, which are small sized compared to the hard sail sections, of high strength material such as steel or the like.

In accordance with a preferred embodiment of the present invention, each hard sail section is provided with members for maintaining the wing-shaped hollow cross section at the upper end and the lower end, the member at the upper end is the connecting member for connecting the upper end of the hard sail section to the upper end of the mast section located at the same level, and the member at the lower end is a frame surrounding the outer circumferential surface of the hard sail section.

It is desirable to provide each hard sail section with members for maintaining the wing-shaped hollow cross section at the upper end and the lower end. As the connecting member for connecting the upper end of the hard sail section to the upper end of the mast section located at the same level is used as the member for maintaining the wing-shaped hollow cross section at the upper end, no other member need be disposed for maintaining the wing-shaped hollow cross section at the upper end. Thus, the number of members for constituting the hard sail assembly can be reduced. The frame surrounding the outer circumferential surface of the hard sail section, which is the member for maintaining the wing-shaped hollow cross section at the lower end, is advantageous in that it does not obstruct the expansion and contraction of the hard sail assembly.

In accordance with a preferred embodiment of the present invention, the sailing unit further comprises means for vertically guiding each hard sail section except the lowermost relative to the hard sail section immediately below.

Expansion and contraction movement of the hard sail assembly can be made smooth by providing the sailing unit with means for vertically guiding each hard sail section except the lowermost relative to the hard sail section immediately below.

More specifically, then, in accordance with a first illustrative embodiment of the invention, a sailing ship is provided that includes (a) a sailing unit that comprises a hard sail assembly comprising a plurality of hard sail sections of wing-shaped hollow cross section vertically stacked so that each, except the lowermost, fits on the one immediately below; (b) a mast assembly comprising a plurality of mast sections of hollow cross section vertically stacked so that each, except the lowermost, fits in the one immediately below; (c) connecting members for connecting the upper ends of the hard sail sections to the upper ends of the mast sections located at the same level; (d) first means for moving each mast section, except the lowermost, toward and away from the one immediately below; and (e) second means for rotating the mast assembly around its longitudinal axis, wherein overlapping lengths between vertically adjacent mast sections are variably controlled to variably control overlapping lengths between vertically adjacent hard sail sections, thereby vertically expanding and contracting the hard sail assembly. In accordance with a second illustrative embodiment of the invention, the first embodiment is modified so that each hard sail section is provided with members for maintaining the wing-shaped hollow cross section at the upper end and the lower end, wherein the member at the upper end is the connecting member for connecting the upper end of the hard sail section to the upper end of the mast section located at the same level, and the member at the lower end is a frame surrounding the outer circumferential surface of the hard sail section. In accordance with a third embodiment of the present invention, the first embodiment is modified so that the sailing unit further comprises means for vertically guiding each hard sail section except the lowermost relatively to the hard sail section immediately below. In accordance with a fourth embodiment of the present invention, the second embodiment is further modified so that the sailing unit further comprises means for vertically guiding each hard sail section except the lowermost relatively to the hard sail section immediately below.

DETAILED DESCRIPTION OF THE PREFERRED EMBODIMENTS

Preferred embodiments of the present invention will be described.

Figure 1:
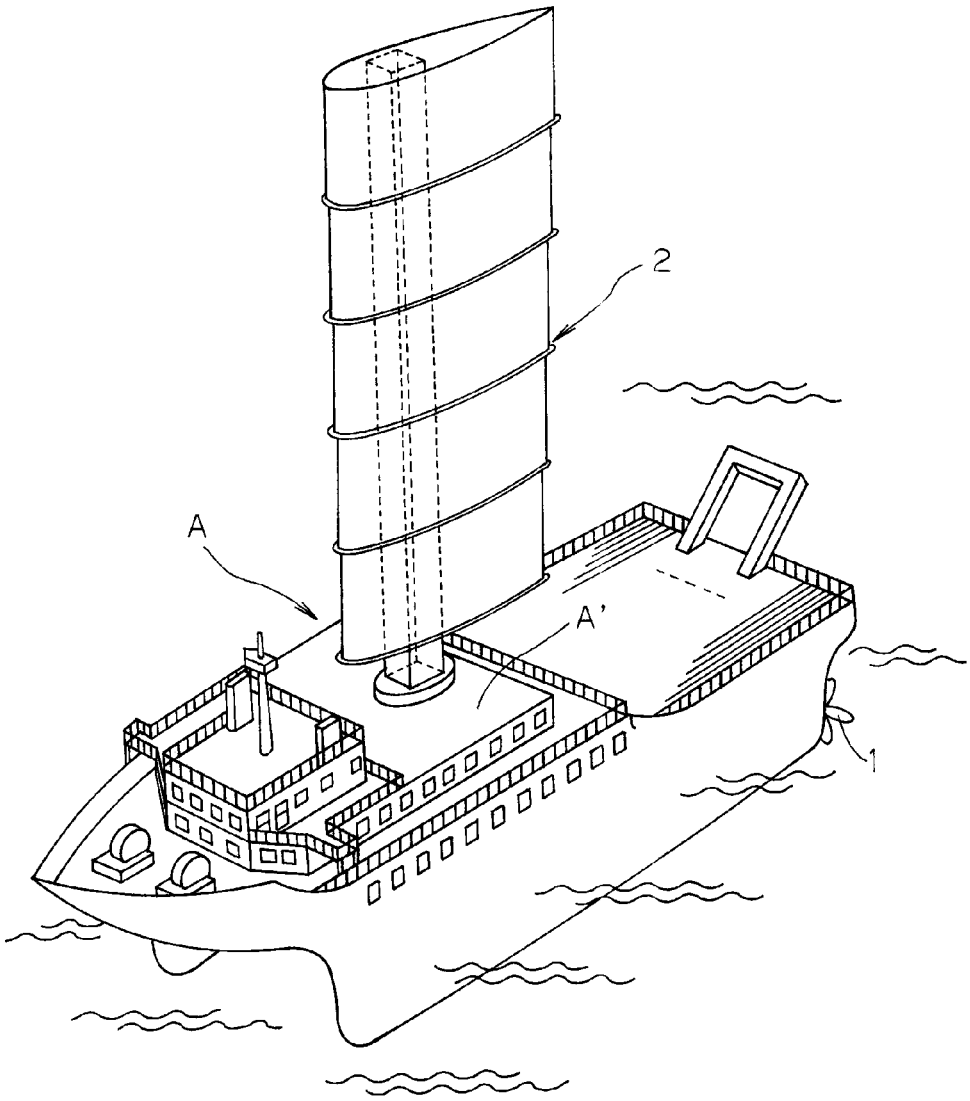
FIG. 1 is a perspective view of an ocean research ship in accordance with a preferred embodiment of the present invention.

As shown in FIG. 1, a catamaran type ocean research ship A is equipped with a propeller propulsion unit 1 and further with a sailing unit 2 having a hard sail.

Figure 2:
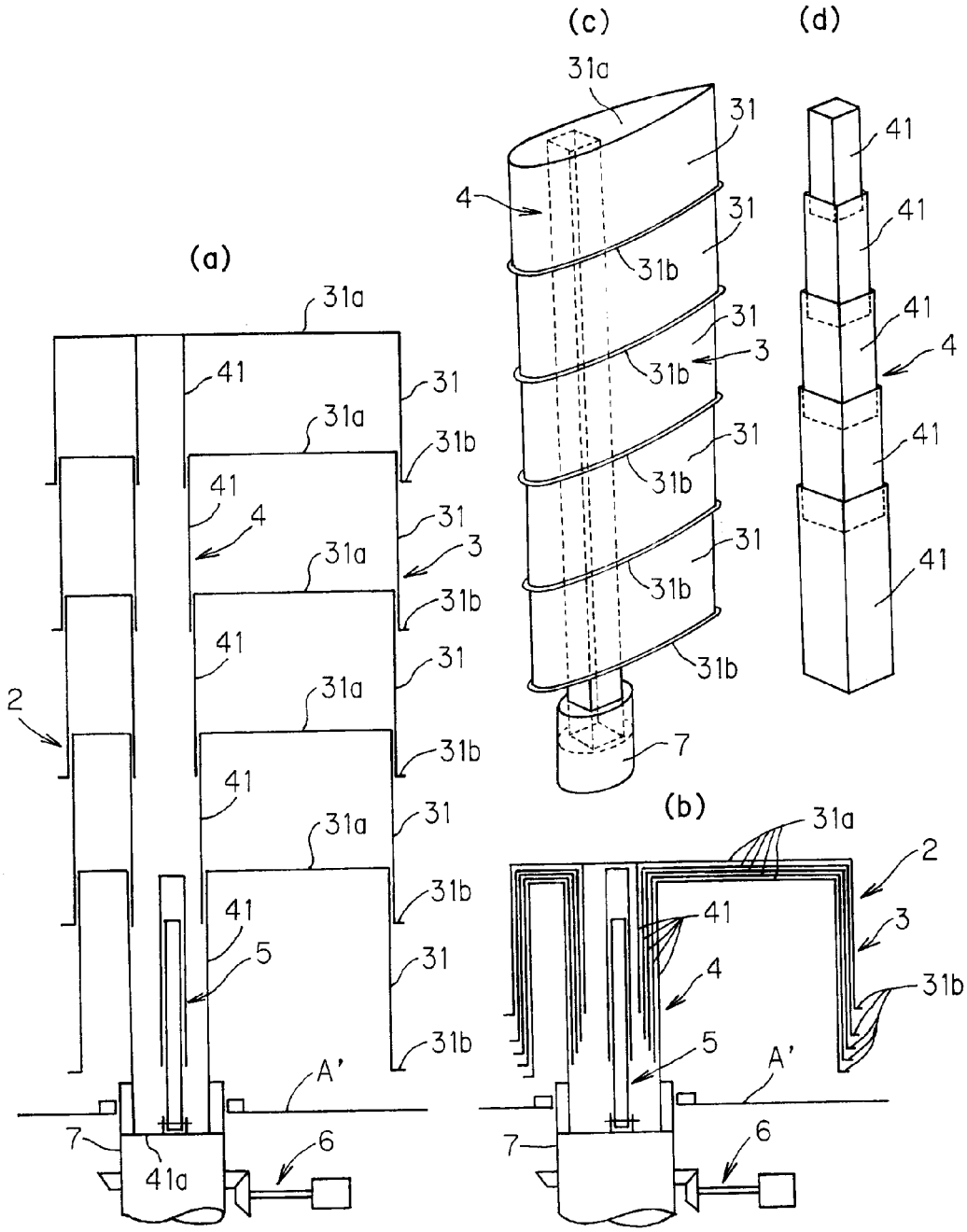
FIG. 2 is a set of structural views of a sailing unit of the ocean research ship in accordance with the preferred embodiment of the present invention, in which (a) is a sectional view in the direction of chord length of a hard sail assembly in expanded condition, (b) is a sectional view in the direction of chord length thereof in contracted condition, (c) is a perspective view thereof, and (d) is a perspective view of a mast assembly.

As shown in FIG. 2, the sailing unit 2 comprises a hard sail assembly 3, a mast assembly 4, a hydraulic cylinder 5 for expanding and contracting the mast assembly 4, a motor gear unit 6 for rotating the mast assembly 4 around the longitudinal axis thereof, engaging-disengaging units between mast sections, and engaging-disengaging units between the mast sections and the hydraulic cylinder 5. The engaging-disengaging units between the mast sections and the engaging-disengaging units between the mast sections and the hydraulic cylinder 5 will be described later in detail.

As shown in FIG. 2, the hard sail assembly 3 comprises five hard sail sections 31 made of carbon fiber reinforced plastic. The five hard sail sections 31 are vertically stacked. Each hard sail section 31 has a symmetrical wing-shaped hollow cross section. Each of the upper four hard sail sections 31 is telescopically fitted on the hard sail section 31 immediately below. Each hard sail section 31 is provided with a top plate 31*a* at the upper end and with a frame 31*b* at the lower end. The frame 31*b* surrounds the outer circumferential surface of the hard sail section 31.

As shown in FIG. 2, the mast assembly 4 comprises five mast sections 41 made of steel. The five mast sections 41 are vertically stacked. Each mast section 41 has a square hollow cross section. Each of the upper four mast sections 41 is telescopically fitted in the mast section 41 immediately below.

The upper ends of the hard sail sections 31 are connected to the upper ends of the mast sections 41 located at the same level by the top plates 31*a*.

The upper end of the uppermost mast section 41 is closed by the top plate 31*a* of the uppermost hard sail section 31. The upper end of each of the lower four mast sections 41 is open. The lower end of the lowermost mast section 41 is closed by a bottom plate 41*a*. The lower end of each of upper four mast section 41 is open.

The hydraulic cylinder 5 is disposed in the lowermost mast section 41. The hydraulic cylinder 5 is mounted on the bottom plate 41*a* of the lowermost mast section 41 to extend upward.

A mast base member 7 vertically extends through a deck A' of the ocean research ship A to support the lowermost mast section 41. The motor gear unit 6 engages the mast base member 7.

Figure 3:
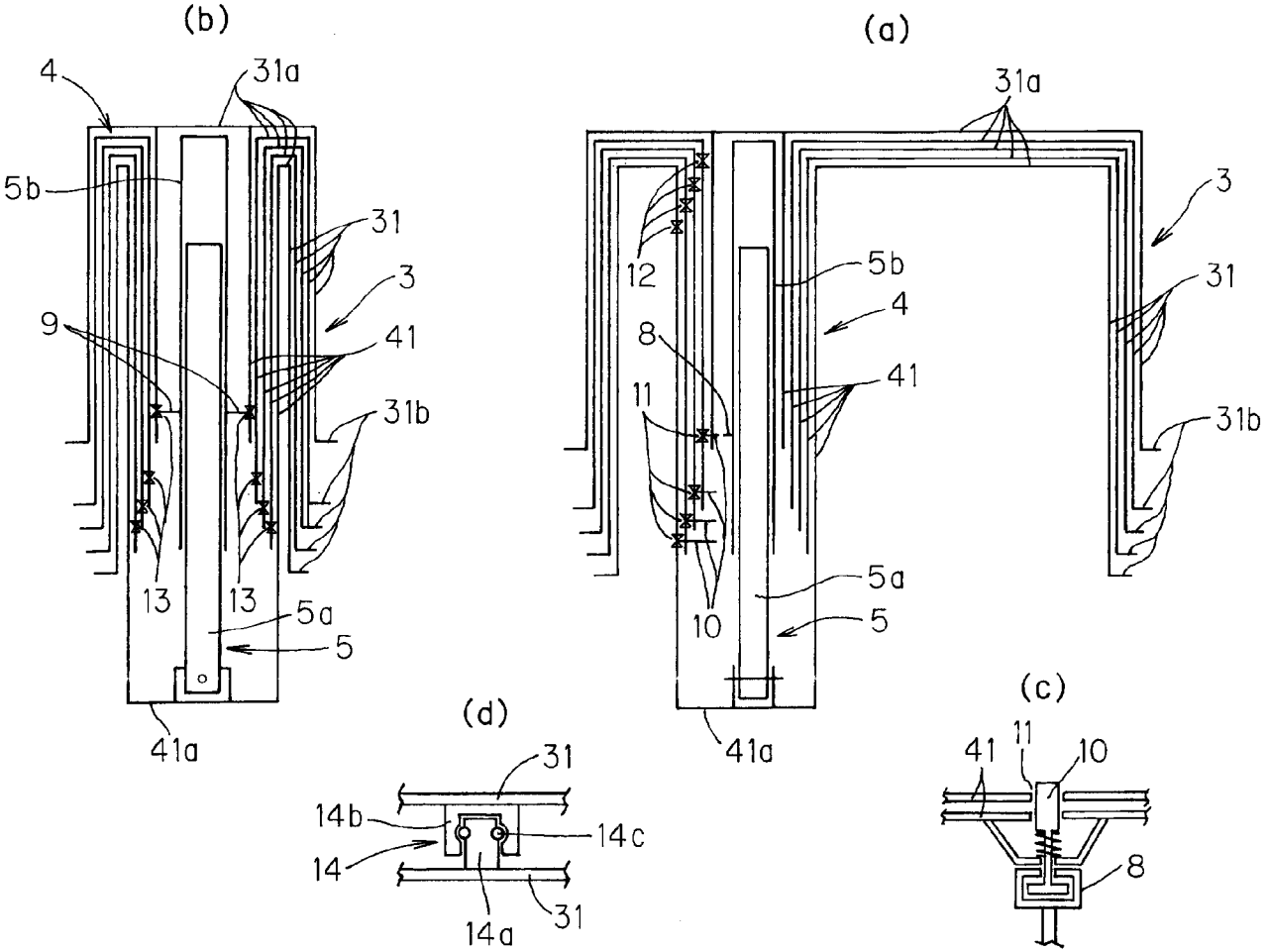
FIG. 3 is a set of sectional views showing the contracted condition of the hard sail assembly, the mast assembly and a hydraulic cylinder constituting a sailing unit of the ocean research ship in accordance with the preferred embodiment of the present invention, in which (a) is a sectional view in the direction of chord length showing engaging-disengaging units between the mast sections, (b) is a sectional view in the direction of wing thickness showing engaging-disengaging units between the mast sections and the hydraulic cylinder, (c) is a horizontal sectional view of an engaging-disengaging unit between the mast sections and (d) is a horizontal sectional view of a guide member disposed between the hard sail sections.

As shown in FIG. 3, the hydraulic cylinder 5 comprises a cylinder rod 5*a* swingably supported by the bottom plate 41*a* of the lowermost mast section 41 and a cylinder tube 5*b* into which the upper portion of the cylinder rod 5*a* is inserted.

The engaging-disengaging units between mast sections and the engaging-disengaging units between the mast sections and the hydraulic cylinder will be described below. Details of an expansion-contraction unit for the mast assembly 4 using the engaging-disengaging units between mast sections and the engaging-disengaging units between the mast sections and the hydraulic cylinder as described below are the same as those disclosed in, for example, Japanese Patents Nos. 3212467 and 4263280.

The cylinder tube 5*b* is provided with an engaging member 8 horizontally reciprocated by a hydraulic cylinder not shown in the figures and a pair of pins 9 horizontally reciprocated by another hydraulic cylinder not shown in the figures. The engaging member 8 and the pair of pins 9 are distanced from each other by 90 degrees in the circumferential direction.

Each of the upper four mast sections 41 is provided at a portion near the lower end with a pin 10 horizontally and outwardly forced by a spring.

Each of the lower four mast sections 41 is provided at the portion near the lower end with a hole 11 into which the pin 10 of the mast section 41 immediately above can be fitted. Each of the lower four mast sections 41 is provided at the portion near the upper end with a hole 12 into which the pin 10 of the mast section 41 immediately above can be fitted.

Each of the upper four mast sections 41 is provided at the portion near the lower end with a pair of holes 13 into which the pair of pins 9 of the cylinder tube 5*b* can be fitted.

Operation of the sailing unit 2 will be described.

When the ocean research ship A does not use the sailing unit 2, the hydraulic cylinder 5 contracts as shown in FIG. 3. The overlapping lengths between vertically adjacent mast sections 41 become maximum to contract the mast assembly 4, thereby maximizing the overlapping lengths between vertically adjacent hard sail sections 31 to contract the hard sail assembly 3.

The engaging member 8 of the cylinder tube 5*b* is projected to an extended position so as to engage the pin 10 of the uppermost mast section 41. The engaging member 8 engages the pin 10 in the horizontal direction but not in the vertical direction as is clear from FIG. 3(*c*).

The pair of pins 9 of the cylinder tube 5*b* is projected to an extended position so as to fit in the pair of holes 13 of the uppermost mast section 41, thereby fixing the uppermost mast section 41 to the cylinder tube 5*b*.

The pin 10 of each of the upper four mast sections 41 is forced by the spring to fit in the hole 11 of the mast section 41 immediately below, thereby fixing each of the upper four mast sections 41 to the mast section 41 immediately below.

When the ocean research ship A uses the sailing unit 2, the engaging member 8 of the cylinder tube 5*b* moves against the force of the spring to a retracted position so as to disengage the pin 10 of the uppermost mast section 41 from the hole 11 of the mast section 41 immediately below, thereby releasing the fixing of the uppermost mast section 41 to the mast section 41 immediately below.

Figure 4:
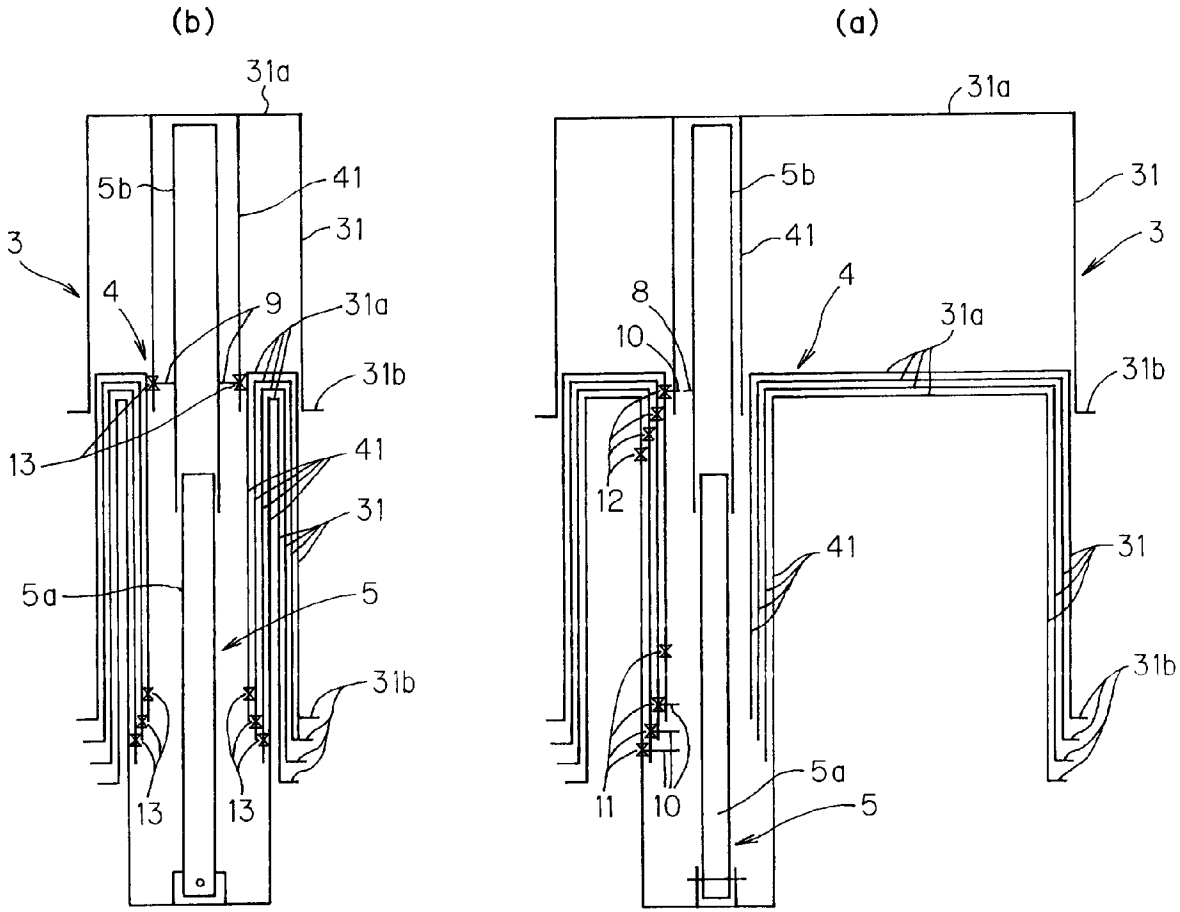
FIG. 4 is a set of sectional views showing an intermediate stage of expansion of the hard sail assembly, the mast assembly and the hydraulic cylinder constituting the sailing unit of the ocean research ship in accordance with the preferred embodiment of the present invention, in which (a) is a sectional view in the direction of chord length showing the engaging-disengaging units between the mast sections, (b) is a sectional view in the direction of wing thickness showing the engaging-disengaging units between the mast sections and the hydraulic cylinder.

As shown in FIG. 4, the hydraulic cylinder 5 expands so as to move the cylinder tube 5*b* upward, thereby moving the uppermost mast section 41 fixed to the cylinder tube 5*b* upward so as to move upward the uppermost hard sail section 31 connected to the uppermost mast section 41 through the top plate 31*a*.

The engaging member 8 of the cylinder tube 5*b* moves to the extended position so as to fit the pin 10 of the uppermost mast section 41 in the hole 12 of the mast section 41 immediately below, thereby fixing the uppermost mast section 41 to the mast section 41 immediately below.

The pair of pins 9 of the cylinder tube 5*b* moves to the retracted position so as to be disengaged from the pair of holes 13 of the uppermost mast section 41, thereby releasing the fixing of the uppermost mast section 41 to the cylinder tube 5*b*.

The hydraulic cylinder 5 retracts so as to move the cylinder tube 5*b* downward. The pin 10 of the uppermost mast section 41 remains fitted in the hole 12 of the mast section 41 immediately below under the biasing force of the spring so as to maintain the fixing of the uppermost mast section 41 to the mast section 41 immediately below. The engaging member 8 located at the extended position, which engages the pin 10 in the horizontal direction but not in the vertical direction, is disengaged from the pin 10 of the uppermost mast section 41 as the cylinder tube 5*b* moves downward. Therefore, the cylinder tube 5*b* can smoothly move downward.

When the engaging member 8 located at the extended position engages the pin 10 of the mast section 41 next to the uppermost mast section 41, the cylinder tube 5*b* stops.

The engaging member 8 moves against the biasing force of the spring to the retracted position so as to disengage the pin 10 of the mast section 41 next to the uppermost mast section 41 from the hole 11 of the mast section 41 immediately below, thereby releasing the fixing of the mast section 41 next to the uppermost mast section 41 to the mast section 41 immediately below.

The pair of pins 9 of the cylinder tube 5*b* move to the extended positions so as to fit in the pair of holes 13 of the mast section 41 next to the uppermost mast section 41, thereby fixing the mast section 41 next to the uppermost mast section 41 to the cylinder tube 5*b*.

The hydraulic cylinder 5 expands so as to move the cylinder tube 5*b* upward, thereby moving upward the mast section 41 next to the uppermost mast section 41 which is fixed to the cylinder tube 5*b* so as to move upward the hard sail section 31 next to the uppermost hard sail section 31 which is connected to the mast section 41 next to the uppermost mast section 41 through the top plate 31*a*.

The engaging member 8 of the cylinder tube 5 moves to the extended position so as to fit the pin 10 of the mast section 41 next to the uppermost mast section 41 in the hole 12 of the mast section 41 immediately below, thereby fixing the mast section 41 next to the uppermost mast section 41 to the mast section 41 immediately below.

The pair of pins 9 of the cylinder tube 5*b* move to the retracted position so as to disengage from the pair of holes 13 of the mast section 41 next to the uppermost mast section 41, thereby releasing the fixing of the mast section 41 next to the uppermost mast section 41 to the cylinder tube 5.

The hydraulic cylinder 5 retracts so as to move the cylinder tube 5*b* downward.

When the engaging member 8 located at the extended position engages the pin 10 of the mast section 41 immediately below the mast section 41 next to the uppermost mast section 41, the cylinder tube 5*b* stops.

The aforementioned operations are repeated so as to reduce the overlapping lengths between vertically adjacent mast sections 41 constituting the mast assembly 4 to the minimum level, thereby reducing the overlapping lengths between vertically adjacent hard sail sections 31 constituting the hard sail assembly 3 to the minimum level so as to telescopically expand the hard sail assembly 3.

The motor-gear unit 6 operates so as to rotate the mast base member 7 around the vertically extending central axis, thereby rotating the mast assembly 4 around the longitudinal axis thereof so as to direct the hard sail assembly 3 in the optimum direction relative to the wind.

The catamaran type ocean research ship A navigates using the thrust of the propeller propulsion unit 1 plus the additional thrust generated by the hard sail assembly 3 of the sailing unit 2.

When the expanded mast assembly 3 is retracted, the aforementioned operations are reversed. That is, each of the upper four mast sections 41 is moved downward toward the mast section 41 immediately below so as to maximize the overlapping lengths between vertically adjacent mast sections 41 constituting the mast assembly 4, thereby maximizing the overlapping lengths between vertically adjacent hard sail sections 31 constituting the hard sail assembly 3.

In the ocean research ship A, the hard sail assembly 3 comprises a plurality of hard sail sections 31 of wing-shaped hollow cross section vertically stacked and can expand and contract so as to change its height. Therefore, the height of the hard sail assembly 3 can be adjusted so as not to obstruct passage of the ship under bridges.

In the ocean research ship A, chord length of the hard sail assembly 3 in expanded condition increases from the lower portion to the higher portion as is clear from FIG. 2(*a*) because the each hard sail section 31 except the lowermost fits on the hard sail section 31 immediately below. On the other hand, wing velocity increases as the height from the deck A' of the ocean research ship A increases. Therefore, the hard sail assembly 3 of the ocean research ship A can efficiently catch the wind force.

In the ocean research ship A, the upper ends of the hard sail sections 31 are connected to the upper ends of the mast sections 41 located at the same level so that the hard sail sections 31 are supported by the mast sections 41 located at the same level. Therefore, the sailing unit 2 can be made lightweight and imparted with appropriate strength by making the hard sail sections 31, which are large sized, of lightweight resin and making the mast sections 41, which are small sized compared to the hard sail sections 31, of high strength material such as steel or the like.

The top plates 31*a* provided on the upper ends of the hard sail sections 31 and the frames 31*b* provided on the lower ends of the hard sail sections 31 effectively operate as members for maintaining the wing-shaped hollow cross sections of the hard sail sections 31. No other member need be disposed at the upper ends of the hard sail sections 31 so as to maintain the wing-shaped hollow cross section because the top plates 31*a* for connecting the upper ends of the hard sail sections 31 to the upper ends of the mast sections 41 are used as the members for maintaining the wing-shaped hollow cross sections at the upper ends of the hard sail sections 31. Thus, the number of members constituting the hard sail assembly 3 can be reduced. The frames 31*b* surrounding the outer circumferential surfaces of the hard sail sections 31, which are the members for maintaining the wing-shaped hollow cross sections at the lower ends of the hard sail sections 31, are advantageous in that they do not obstruct the expansion and contraction of the hard sail assembly 3.

As shown in FIG. 3(*d*), it is possible to fix a plurality of rails 14*a* circumferentially distanced from each other and extending vertically on the inner surface of each of the upper four hard sail sections 31, and a plurality of carriages 14*b* circumferentially distanced from each other on the upper portion of the outer surface of each of the lower four hard sail sections 31, and engage the rails 14*a* of each of the upper four hard sail sections 31 with the carriages 14*b* of the hard sail section 31 immediately blow through ball bearings 14*c*. Guide members 14 formed by the rails 14*a*, the carriages 14*b* and the ball bearings 14*c* guide vertically each hard sail section 31 except the lowermost relative to the hard sail section 31 immediately below. Therefore, expansion and contraction movement of the hard sail assembly 3 can be made smooth. Other guide member configurations are also possible.

Figure 5:
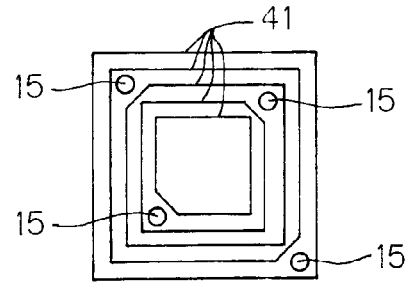
FIG. 5 is a set of structural views of variations of a mast driving unit.
Figure 5:
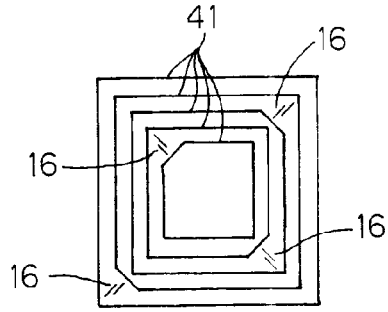
Figure 5:
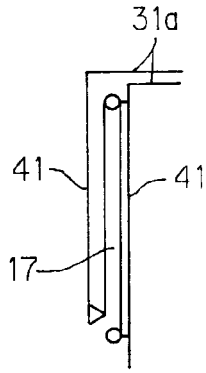
Figure 5:
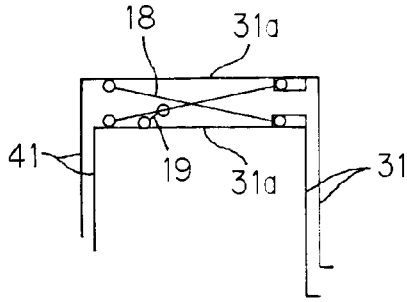

As shown in FIG. 5(*a*), the inner surface of the lower end of each of the lower four mast sections 41 can be connected to the outer surface of the upper end of the mast section 41 immediately above through a hydraulic jack 15 so as to expand and contract the mast assembly 4 by driving four hydraulic jacks 15.

As shown in FIG. 5(*b*), the inner surface of the each of the lower four mast sections 41 can be connected to the outer surface of the mast section 41 immediately above through a rack-and-pinion 16 so as to expand and contract the mast assembly 4 by driving motors provided for the pinions 16.

As shown in FIG. 5(*c*), a hoist 17 can be disposed between each of the lower four mast sections 41 and the mast section 41 immediately above so as to expand and contract the mast assembly 4 by driving four hoists 17.

As shown in FIG. 5(*d*), a pantograph 18 and a hydraulic jack 19 for driving the pantograph 18 up and down can be disposed between the top plate 31*a* of each of the lower four hard sail sections 31 and that of the hard sail section 31 immediately above so as to expand and contract the mast assembly 4 by driving four hydraulic jacks 19.

The mast assembly 4 can be expanded and contracted by driving units other than aforementioned ones. Any driving unit can be used insofar as it can expand and contract the mast assembly 4 and keep the mast assembly 4 at the expanded position.

The motor-gear unit is not restricted to the one shown in FIG. 2. Any motor-gear unit can be used insofar as it can rotate the mast base member 7 around the vertically extending central axis, thereby rotating the mast assembly 4 around the longitudinal axis thereof so as to direct the hard sail assembly 3 in the optimum direction relative to the wind.

The sailing unit 2 can be installed on various kinds of commercial ships, passenger ships, etc.

The invention claimed is:

1. A sailing ship comprising (a) a sailing unit that comprises a hard sail assembly comprising a plurality of hard sail sections of wing-shaped hollow cross section vertically stacked so that each one, except the lowermost one, fits on the one immediately below;

(b) a mast assembly comprising a plurality of mast sections of hollow cross section vertically stacked so that each one, except the lowermost one, fits in the one immediately below;

(c) connecting members for connecting upper ends of the hard sail sections to upper ends of the mast sections located at the same level;

(d) first means for moving each mast section, except the lowermost one, toward and away from the one immediately below; and (e) second means for rotating the mast assembly around a longitudinal axis of the mast assembly, wherein overlapping lengths between vertically adjacent mast sections are variably controlled to variably control overlapping lengths between vertically adjacent hard sail sections, thereby vertically expanding and contracting the hard sail assembly.

2. A sailing ship of claim 1, wherein each hard sail section is provided with members for maintaining the wing-shaped hollow cross section at an upper end and at a lower end, wherein the member at the upper end is the connecting member for connecting the upper end of the hard sail section to the upper end of the mast section located at the same level, and the member at the lower end is a frame surrounding the outer circumferential surface of the hard sail section.

3. A sailing ship of claim 1, wherein the sailing unit further comprises means for vertically guiding each hard sail section, except the lowermost one, relatively to the hard sail section immediately below.

4. A sailing ship of claim 2, wherein the sailing unit further comprises means for vertically guiding each hard sail section, except the lowermost one, relatively to the hard sail section immediately below.

* * * * *